US005356453A

United States Patent [19]

Takata

[11] Patent Number: 5,356,453

[45] Date of Patent: Oct. 18, 1994

[54] MIXED POWDER FOR POWDER METALLURGY AND SINTERED PRODUCT THEREOF

[75] Inventor: Jinsuke Takata, Kobe, Japan

[73] Assignee: Kabushiki Kaisha Kobe Seiko Sho, Kobe, Japan

[21] Appl. No.: 889,421

[22] Filed: May 28, 1992

[30] Foreign Application Priority Data

May 28, 1991 [JP] Japan ..... 3-154123
May 28, 1991 [JP] Japan ..... 3-154124
May 28, 1991 [JP] Japan ..... 3-154125

[51] Int. Cl.[5] ..... C22C 29/14

[52] U.S. Cl. ..... 75/244; 75/246; 75/254; 75/255; 419/10; 419/23

[58] Field of Search ..... 75/245, 246, 252, 255, 75/254, 244; 419/23, 10

[56] References Cited

U.S. PATENT DOCUMENTS

| | | | |
|---|---|---|---|
| 3,689,257 | 9/1972 | Oda et al. | 419/47 |
| 3,937,630 | 2/1976 | Kimura et al. | 419/47 |
| 3,950,165 | 4/1976 | Oda et al. | 419/39 |
| 4,060,414 | 11/1977 | Kaufman | 75/246 |
| 4,071,354 | 1/1978 | Mocarski | 75/255 |
| 4,155,754 | 5/1979 | Lynn | 419/132 |
| 4,204,031 | 5/1980 | Takemura et al. | 428/539.5 |
| 4,382,818 | 5/1983 | Mocarski | 419/11 |
| 4,904,302 | 2/1990 | Shimomura | 75/233 |

OTHER PUBLICATIONS

Hausner, Henry H.; "Handbook of Powder Metallurgy", 1973, Chemical Publishing Co., Inc., New York, N.Y.

Chemical Abstracts, vol. 111, No. 20, Nov. 13, 1989, No. 178454z, T. Nishida, et al., "Densification of Iron Powder Compacts by Liquid Phase Sintering Using Iron-Nickel-Boron Master Alloy Powder and Improvement of Their Mechanical Properties".

Patent Abstracts of Japan, vol. 10, No. 287 (C-375), Sep. 30, 1986 & JP-A-61-104-052, May 22, 1986, Takahashi Yoshitaka, et al., "High-Strength Ferrous Sintered Alloy".

Powder Metallurgy, vol. 28, No. 3, pp. 121-129, 1985, B. A. James, "Liquid Phase Sintering in Ferrous Powder Metallurgy".

Powder Metallurgy, vol. 28, No. 2, pp. 65-71, 1985, S. J. Jamil, et al., "Investigation and Analysis of Liquid Phase Sintering of Fe-Cu and Fe-Cu-C Compacts".

*Primary Examiner*—Donald P. Walsh
*Assistant Examiner*—Ngoclan T. Mai
*Attorney, Agent, or Firm*—Oblon, Spivak, McClelland, Maier & Neustadt

[57] ABSTRACT

A mixed powder for powder metallurgy comprising a Fe powder and an alloy powder mixed together in which the mean particle size and the solidus line temperature of the alloy powder and the amount of the liquid phase formed during sintering are so defined as to attain most suitable sintering behavior, that is, the mean particle size of the alloy powder is smaller than 20 μm, the solidus line temperature of the alloy powder is set to higher than 950° C. and lower than 1300° C. and the amount of the liquid phase formed during sintering is more than 20%. A sintered product having desired properties can be obtained by using the mixed powder described above.

9 Claims, 19 Drawing Sheets

MIXED POWDER FOR POWDER METALLURGY AND SINTERED PRODUCT THEREOF

BACKGROUND OF THE INVENTION

1. Field of the Invention

The present invention concerns a mixed powder for powder metallurgy based on a Fe powder and an alloy powder and capable of providing a sintered product having high density and high strength and with less scattering in dimensional accuracy upon sintering, as well as a sintered product obtained therefrom.

2. Description of the Prior Art

Powder metallurgy is a process of compacting and then sintering a metal powder as a raw material into a final product which drastically changes existent production processes comprising, for example, rolling, forging and casting. Accordingly, it is possible by the powder metallurgy to produce parts which were difficult to be produced by existing melting processes, for example, high melting metal materials such as W and Mo, porous materials for oil-impregnated bearings or filters, super hard alloys or thermits. In addition, since the powder metallurgy has various kinds of advantages not obtainable with materials produced by melting, for example, a merit from a view point of production such as improved material yield attained by non-cutting and high dimensional accuracy and a merit from, a view point of physical properties such as less segregation and anisotropy which are liable to occur in the materials produced by melting. Accordingly, various kinds of parts, which were produced so far by the melting process have now been produced also by powder metallurgy.

Most of sintered products produced at present by the powder metallurgy are used for automobile parts and, among all, sintered Fe materials have been used generally. Various sintered Fe materials have been known and, for example, materials prepared by mixing fine powders of graphite, copper, etc. to a Fe powder as the main ingredient and sintering them with an aim of improving strength, weather proofness, abrasion resistance, etc. have been known. Further, with a view point of extending the application range of sintering parts, higher toughness and strength have become demanded for the sintered parts and a method of adding and alloying elements such as Ni and Mo has also been known as a means for achieving such a demand.

By the way, as a typical method for obtaining a high strength Fe series sintered product by the powder metallurgy, a premix method and a prealloying method has been known.

Premixing is a method of homogeneously mixing a Fe powder with a metal powder or an alloy powder (hereinafter some time referred to as added metal powder), compacting them and subsequently sintering them under heating to solid-solubilize added elements. The method has a merit that the molding fabrication is relatively simple but it involves a drawback that the added metal powder in the Fe powder causes separation or segregation due to difference of the specific gravity in the course up to compaction or diffusion of the added metal powder does not proceed sufficiently during sintering, which leads to a quality problem of causing scattering in the strength and the size of the sintered product.

On the other hand, the prealloying is a method of using an alloyed steel powder in which alloying elements such as Ni, Cu, Mo and Cr are previously solid-solubilized in Fe and the method is free from the problem as mentioned for the premixing method. However, since the alloyed steel powder obtained by prealloying is extremely hard as compared with a pure Fe powder, it involves a problem that compaction density can not be increased sufficiently during compaction making it difficult to obtain a sintered product of high density and, accordingly, physical properties of the alloyed steels can not be enjoyed sufficiently.

Each of the methods described above has respective merits and demerits, but it is considered that the premixing is more advantageous than the prealloying in obtaining a desired sintered product if the above-mentioned disadvantage such as occurrence of segregation or insufficient diffusion can be overcome.

By the way, for the method of preventing the segregation, a method of depositing a graphite powder on an iron-steel powder by using an organic binder has been proposed as described, for example, in Japanese Patent Laid-Open Sho 56-136901 and Sho 63-103001. Further, a so-called diffusing deposition method of diffusing to deposit other metal or alloy powder to a Fe powder has been developed as described, for example, in Japanese Patent Publication Sho 45-9649 and Japanese Patent Laid-Open Sho 63-297502. Particularly, the diffusing deposition method scarcely degrades a compacting property and can prevent the problem of scattering in the strength reduction and the dimensional accuracy caused by the segregation to some extent. That is, in the diffusing deposition type alloyed steel powder, an elemental metal powder of Ni, Cu, Mo, etc., or an alloyed powder thereof is added to and uniformly mixed with a Fe powder and the added metal powder is diffused to deposit to the surface of the Fe powder by a diffusing treatment, in which the powder once deposited by diffusion causes no segregation.

On the other hand, various technics have been proposed so far also for improving the diffusibility, but most of the existent technics have been based on the view point considering the kind and the amount of the added metal powder and none of them mentions to the sintering behavior which is expected to provide a significant effect on the appearance of the strength.

OBJECT OF THE INVENTION

The present invention has been achieved in view of the foregoing situations and it is an object thereof to provide a mixed powder for powder metallurgy, being based on the premixing method, capable of providing a sintered product having high density, high strength and homogeneous structure with a view point of analyzing the sintering behavior as well as a sintered product having such properties.

SUMMARY OF THE INVENTION

The foregoing object can be solved by the present invention with a mixed powder for powder metallurgy comprising a Fe powder and an alloy powder mixed together in which the solidus line temperature of the alloy powder is higher than 950° C. and lower than 1300° C. and the amount of liquid phase formed during sintering is more than 20%. Further, there can be mentioned a composition for the alloy powder comprising Ni, Mo and Mn as the essential ingredient and containing one or more of elements selected from the group consisting of Cr, Si, Al, Ti, P, V, Nb, Sn, W, Co, Cu and B. Further, when the mixed powder as described above is sintered, a sintered product having high density and high strength and homogeneous structure is obtained. Particularly, in the structure of the sintered product according to the present invention, martensite develops in a network configuration along the grain boundary of the Fe powder.

DESCRIPTION OF THE INVENTION

Figure 1:
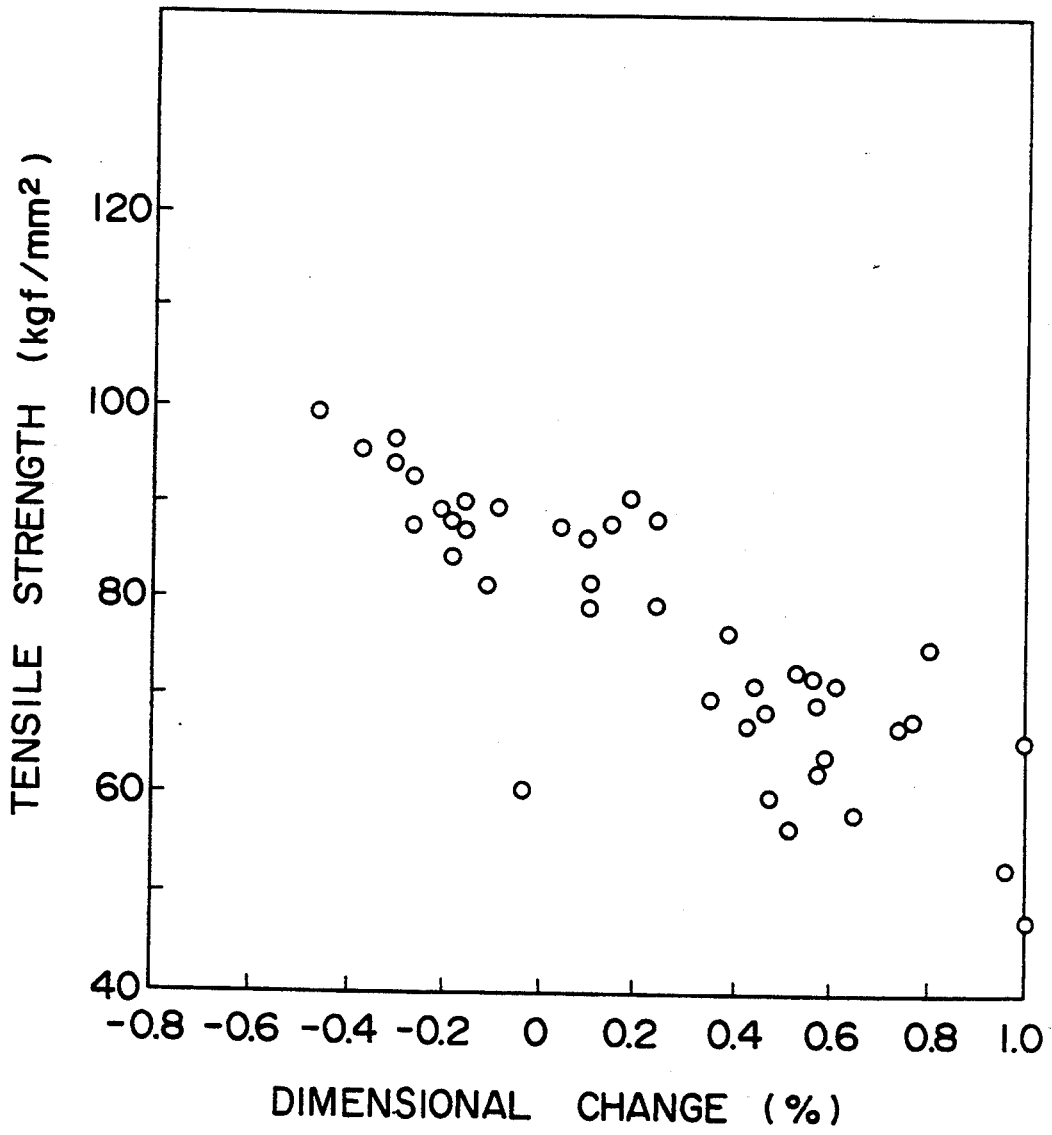
FIG. 1 is a graph illustrating a relationship between the dimensional change and the tensile strength of a sintered product.

A sintering temperature upon producing a high strength Fe series sintered member is usually about 1250° to 1300° C. When an alloy powder added to a Fe powder is a Ni—Mo series powder, since the solidus line temperature is high (higher than 1315° C.) and no liquid phase appears at the sintering temperature as described above, a sintered product having desired high density and high strength can not be obtained. On the other hand, when a certain kind of element is added to the Ni—Mo—Mn series alloy powder described above with an aim of forming such an alloy as lowering the solidus line temperature, it has been found that the temperature at which the liquid phase of the alloy powder appears can be reduced to lower than the sintering temperature in which the liquid phase formed upon sintering surrounds Fe particles to form an alloy phase in a sterical structure, and the alloy phase is easily converted into martensite even if the cooling rate during sintering is low in view of the composition, in which the martensite structure develops into a network configuration along the grain boundary of the Fe powder to provide a sintered product of high density and high strength. Then, it has been found that Cr, Si, Al, Ti, P, V, Nb, Sn, W, Co, Cu or B is preferred as such an element and one or more of elements selected from the above-mentioned group may be added.

With a view point of improving the diffusibility of the alloy powder, it is expected that a lower solidus line temperature is preferred. However, it has been found that if the temperature is too low, it overlaps with a carburizing region of graphite added as an auxiliary raw material, causing remarkable expansion and rather lowering the strength of the sintered product.

The present inventors have made various investigations in view of avoiding such a disadvantage and have found that the solidus line temperature of the alloy powder may be higher than 950° C. and lower than 1300° C. It has been found that the amount of the liquid phase during sintering is also important and a desired strength can not be obtained unless the amount of the liquid phase upon sintering is not more than 20%. The present invention has thus been completed based on such findings.

By the way, in the present invention, the alloy ingredients such as Ni, Mo and Mn have to be in an alloyed form not in the form of individual metal powders. That is, individual alloying elements such as Ni, Mo and Mn have high melting point and exhibit slow diffusion rate into the Fe powder but the melting point can be lowered than that for the elemental powder when such elements are previously alloyed, to improve the diffusibility into the Fe powder and contribute to the improvement of the strength of the sintered product.

Use of the alloying elements in a previously alloyed form is effective also from a view point of obtaining a sintered product having uniform characteristics. That is, for the procedures of obtaining a sintered product by using the mixed powder according to the present invention, any of procedures can be adopted, such as (1) mixing the powder as it is with other auxiliary raw materials and sintering them or (2) previously depositing the Fe powder and the alloy powder by using a binder or a diffusing treatment, then mixing them with other auxiliary raw material and then sintering them. In using any of the procedures, a sintering powder having a uniform alloying ingredient ratio from a micro point of view can be obtained by using an alloyed powder. Accordingly, the properties of the powder are made constant and the properties of the resultant sintering product also become uniform. Further, use of the alloying elements in a previously alloyed form is effective also from a view point of reducing the addition amount of the alloy for the development of the strength.

As has been described above, the mixed powder according to the present invention can be either in the form of a binder deposition type sintering powder or a diffusing deposition type sintering powder. The diffusing deposition type powder is particularly preferred and the same effect as that obtained by two step annealing treatment can be obtained by the subsequent sintering treatment.

Description will now be made to the ingredients of the alloy powder used in the present invention.

The alloy powder used in the present invention comprises Ni, Mo and Mn as the basic ingredient, in which Ni has an effect of improving the toughness, while Mo improves the hardening property and prevents softening upon hardening and tempering.

By the way, a Ni—Mo series alloy has an eutectic point in the vicinity of 50% Mo (% by weight here and hereinafter) and the high melting property of Mo can be lowered in the form of the Ni—Mo series alloy, by which diffusibility into a Fe powder, that is, homogeneous alloying is facilitated. However, if Mo is present too much, since the liquidus line temperature is increased abruptly, the effect of lowering the melting point is reduced. In view of the above, the Ni to Mo ratio should be about Ni:45–95% and Mo: about 55–5%.

Addition of Mn lowers the melting point of the alloy powder, improves the diffusibility of the alloy powder and contributes to the formation of a homogeneous martensite structure developed into a network configuration in a sintered product according to the present invention. Such an effect can be attained by more than 5% Mn based on the total amount of Ni and Mo. However, if it is added too much, this may rather make the formation of the martensite difficult, tending to induce oxidization in the sintering step and making it difficult to obtain the strength of the sintered product. Accordingly, the addition amount of Mn should be restricted to about 50% based on the total amount of Ni and Mo.

The alloy powder used in the present invention comprise, in addition to Ni, Mo and Mn, one or more of elements selected from the group consisting of Cr, Si, Al, Ti, P, V, Nb, Sn, W, Co, Cu and B. They lower the melting point of the alloy powder to improve the diffusibility into-the Fe powder and are also effective in view of the improvement for the strength. However, if the elements are added too much, the effect obtained by the basic ingredients such as Ni, Mo and Mn described above is reduced and the solidus line temperature of the alloy powder becomes too low. In view of the above, the addition amount of such elements should be about 5 to 100 parts based on the 100 parts by weights in total of the basic ingredients such as Ni, Mo and Mn. Further, the ratio of the alloying elements to the Fe powder is preferably about 1 to 12%. If the ratio is higher, mechanical properties of sintered products get worse because of the formation of residual austenite.

There is particular restriction on the particle size of the alloy powder used in the present invention and it should be smaller than 20 μm in the mean particle size. This is because the alloying of the alloy powder into the Fe powder during sintering is worsened if the mean particle size is too great, making it difficult to obtain a homogeneous structure and causing scattering of the property such as strength and hardness.

Cu can be incorporated as the composition ingredient of the alloy powder as described above. However, the addition amount of Cu has to be restricted to less than 10% of the alloy powder since the dimension upon sintering is liable to expand if the addition amount thereof is excessive. That is, as the addition amount of Cu increases, abnormal expansion referred to as Cu-growth occurs, which reflects on a significant dimensional change. For such an abnormal phenomenon, the present applicant has found that dimensional change of the sintered product differs greatly between a case of adding Cu as a metal powder to the Fe powder and a case of adding the Cu as an alloy powder to the Fe powder even if Cu is blended in an identical weight ratio (Japanese Patent Laid-Open Hei 2-217401). It has been found that the dimensional change can be reduced by the addition of Cu in an alloyed form. Accordingly, if Cu is incorporated in the present invention, it is also effective to add it in an alloyed form with a view point of preventing the dimensional change caused by Cu.

There is no particular restriction on the kind (type) of the Fe powder used in the present invention and it will be easily anticipated that it desirable to attain higher density in view of increasing the strength of the sintered product further. However, as shown in examples to be described later, it is preferred to use a Fe powder with somewhat lower purity than using a Fe powder of higher purity in order to attain high strength. That is, it is considered that alloying does not proceed as far as the core of the Fe powder when the powder at high purity is used but this results in a portion not connected into martensite but left as it is in the form of bainite, which gives an undesired effect on the development of the strength. On the other hand, when the sintered product according to the present invention is produced, graphite is used as a binder, and the strength is increased as the graphite powder becomes finer. Further, the strength tends to increase also in the alloy powder as the powder becomes finer.

From the foregoings, in producing the sintered product according to the present invention, the kind of the Fe powder, the grain size of the alloy powder and graphite may properly be selected depending on the application use of the sintered product.

EXAMPLE 1

After compacting a mixed powder comprising Fe powder (water atomized pure Fe powder)—6% alloy powder (various kinds)—0.6% graphite powder—0.75% zinc stearate powder, at 6 ton/cm$^2$, it was sintered in a 10% $H_2$–$N_2$ atmosphere at 1300° C. Then, for each of the resultant sintered products, (1) a relationship between the dimensional change and the tensile strength and (2) thermal expansion curves during sintering were investigated. The alloy powders used herein were prepared by water atomization, had mean particle size of about 17 μm and were added each in an identical addition amount while varying the content of Ni, Mo and Mn, in which the elements such as Cr, Si, P and Sn were incorporated each by a predetermined amount to the basic ingredients described above.

FIG. 1 is a graph illustrating a relationship between the dimensional change and the tensile strength. The size of the powder compacting product changes by sintering and it can be found that the strength reduces as it is expanded as shown in FIG. 1.

Figure 2:
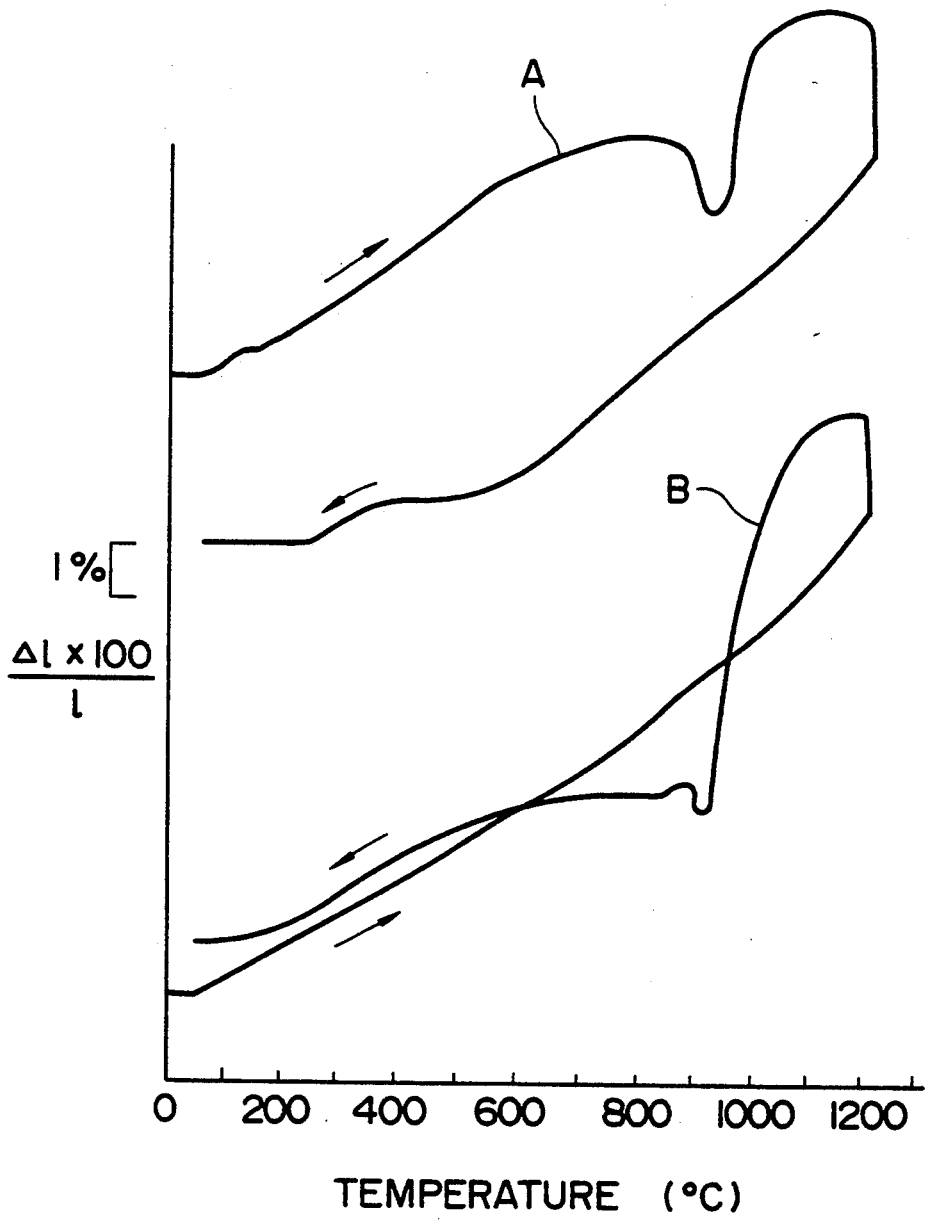
FIG. 2 shows a thermal expansion curve during sintering, in which line A indicates a case of using an alloy powder only containing Ni—Mo, while line B indicates a case in which Cr, Mn and Si are contained by more than 50% in total to Ni and Mo.
Figure 3:
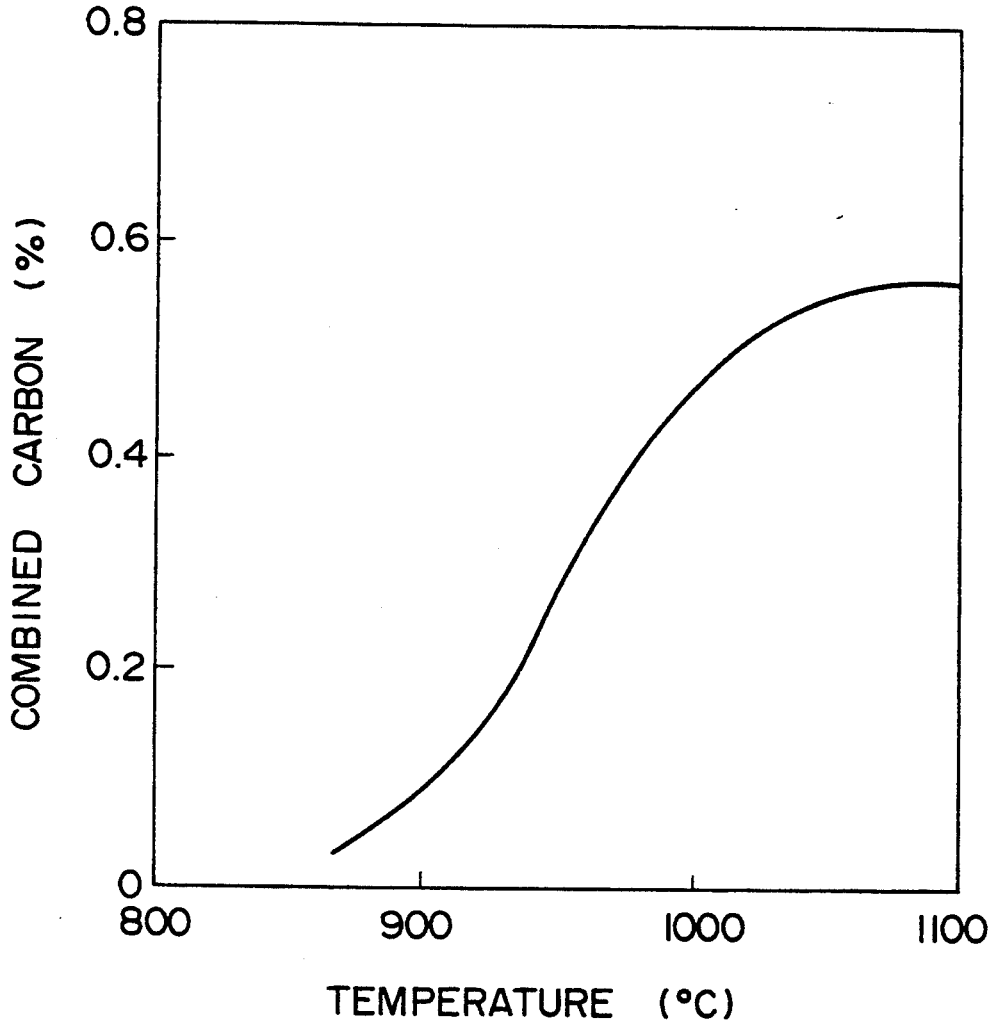
FIG. 3 is a graph illustrating a carburizing behavior of graphite during sintering.

FIG. 2 shows thermal expansion curves during sintering. Line A shows a result in a case of using a powder only containing Ni—Mo as the alloy powder. Since the solidus line temperature of the alloy powder is about 1420 ° C., no liquid phase is formed during sintering and diffusion into the Fe powder the proceeds in a solid phase. On the other hand, line B shows the result of a case of using an alloy powder incorporating Cr, Mn, Si and P by more than 50% in total to Ni—Mo, in which the solidus line temperature is about 930° C. and it is expected that diffusion takes place rapidly in this temperature region (γ-Fe region). However, as shown in FIG. 3 (carburizing behavior of graphite for sintering), since it exhibits a behavior that graphite sintering begins from about 900° C. and completes substantially at about 1060° C., both of the effects overlap to make the expansion remarkable and reduce the strength, since the solidus line temperature of the line B in FIG. 2 is also a graphite carburizing region.

Figure 4:
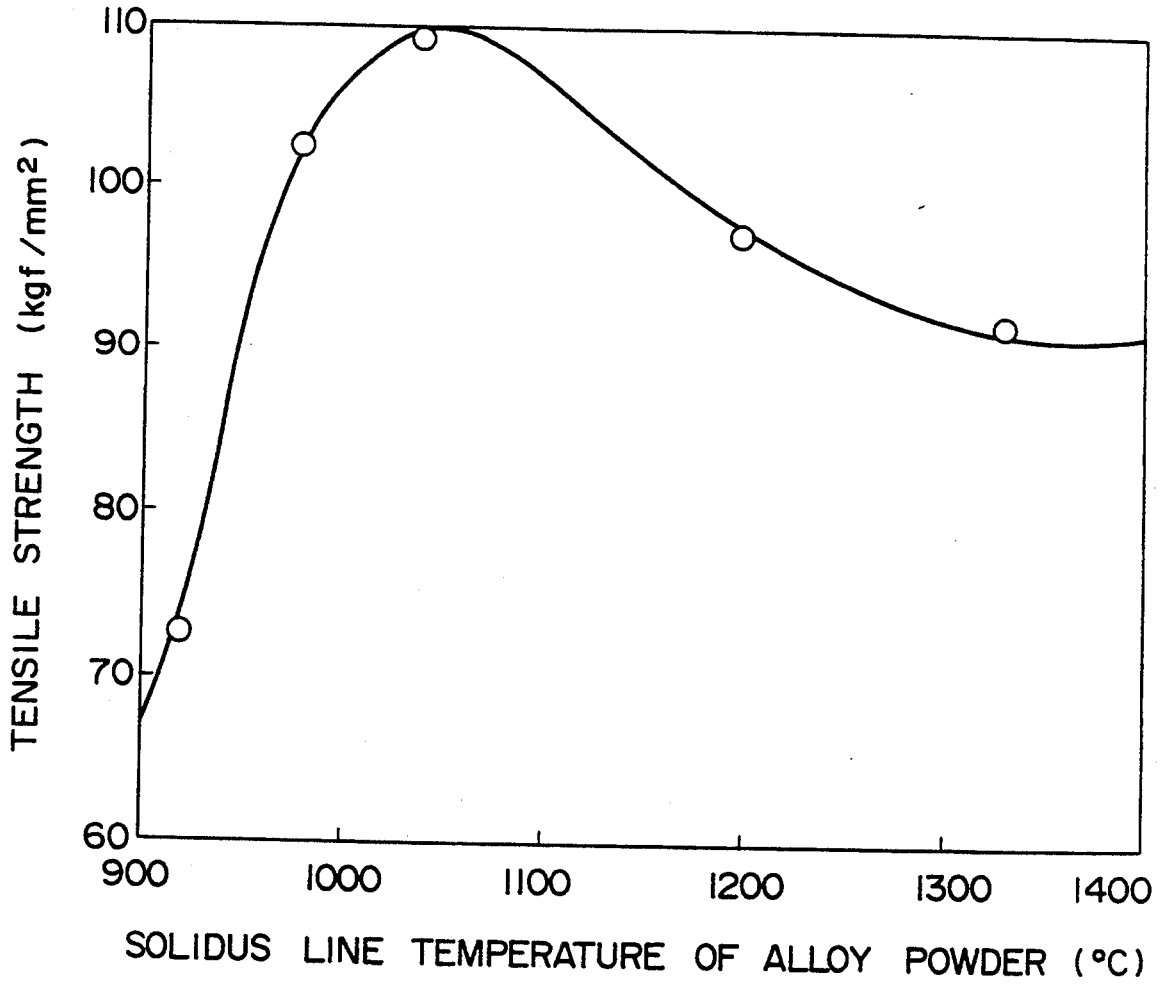
FIG. 4 is a graph illustrating a relationship between the solidus line temperature of the alloyed powder and tensile strength of a sintered product.

FIG. 4 illustrates a relationship between the tensile strength and the solidus line temperature of a sintered product sintered by using the alloy powder in a case when the solidus line temperature of the alloy powder is changed by varying the blending amount of Cr and Si relative to the basic ingredients of Ni, Mo and Mn while keeping the ratio between them constant. As apparent from FIG. 4, the strength of the sintered product shows the highest value in a case of using an alloy powder with the solidus line temperature at about 1040° C., and the strength reduces abruptly in a case of using an alloy powder with a solidus line temperature of lower than 950° C.

Figure 5:
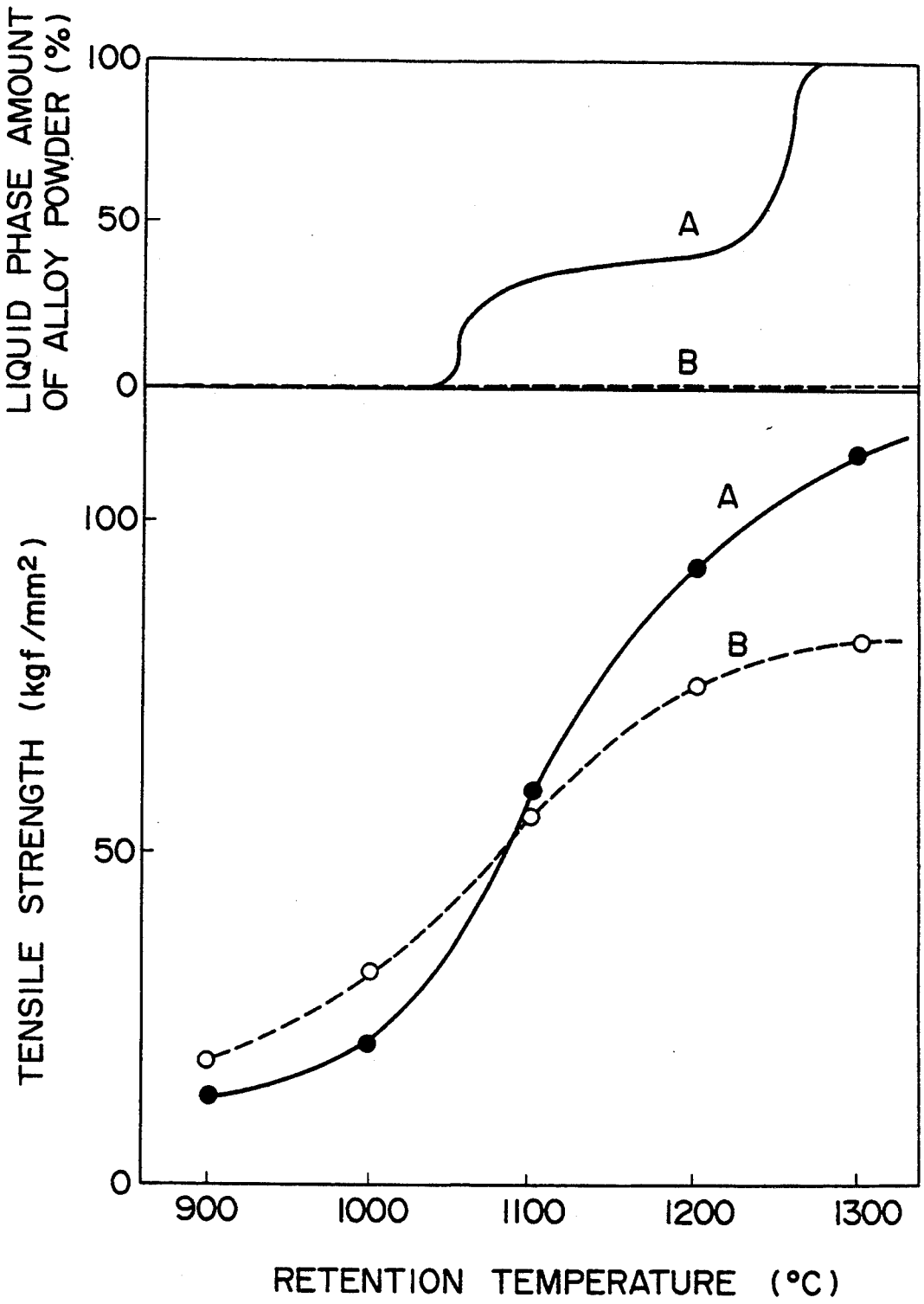
FIG. 5 is a graph illustrating a relationship between the amount of liquid phase formed from the alloy powder and the tensile strength of the sintered product when sintered at each of temperatures for 50 min.

FIG. 5 shows the state of strength development in the sintered product when sintered for 50 min at each of temperatures in which line A shows a case of using a Ni—Mo—Mn—Si—Cr series alloy powder with a solidus line temperature of 1050° C., while line B shows a case of using a Ni—Cu—Mo series alloy powder with a solidus line temperature of 1335° C. In the line B in which no liquid phase is formed during sintering, the strength is improved along with the rise of the sintering temperature but the slope becomes moderate at a temperature in excess of 1200° C. On the other hand, in the line A, the strength is lower than that in the line B up to 1000° C. at which no liquid phase is formed but the strength increases remarkably along with the appearance of the liquid phase and, since the appearance of the liquid phase still continues even in excess of 1200° C., the strength further continues to increase.

Figure 6:
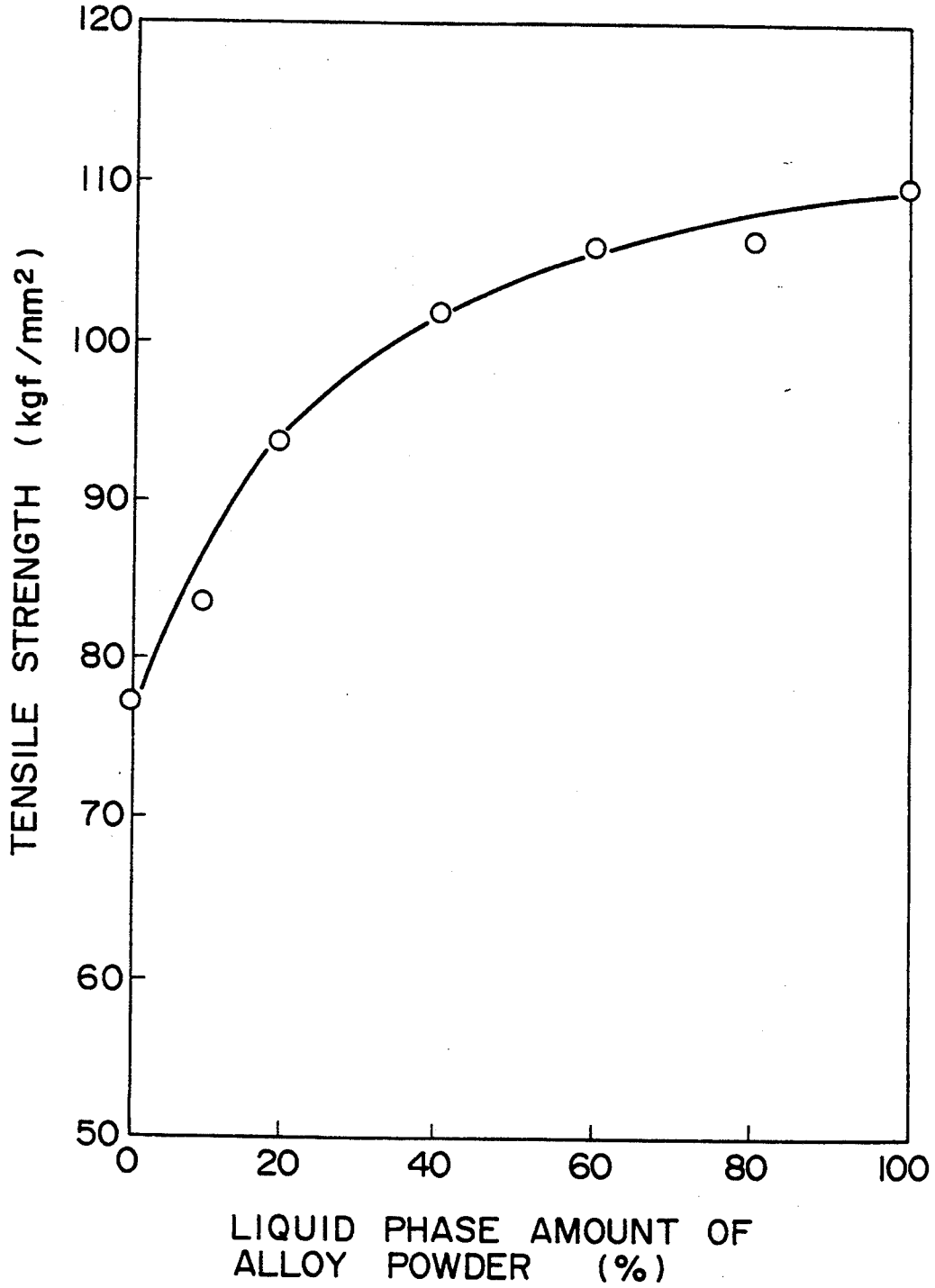
FIG. 6 is a graph illustrating a relationship between the amount of liquid phase formed from the alloy powder and tensile strength of the sintered product.
Figure 7:
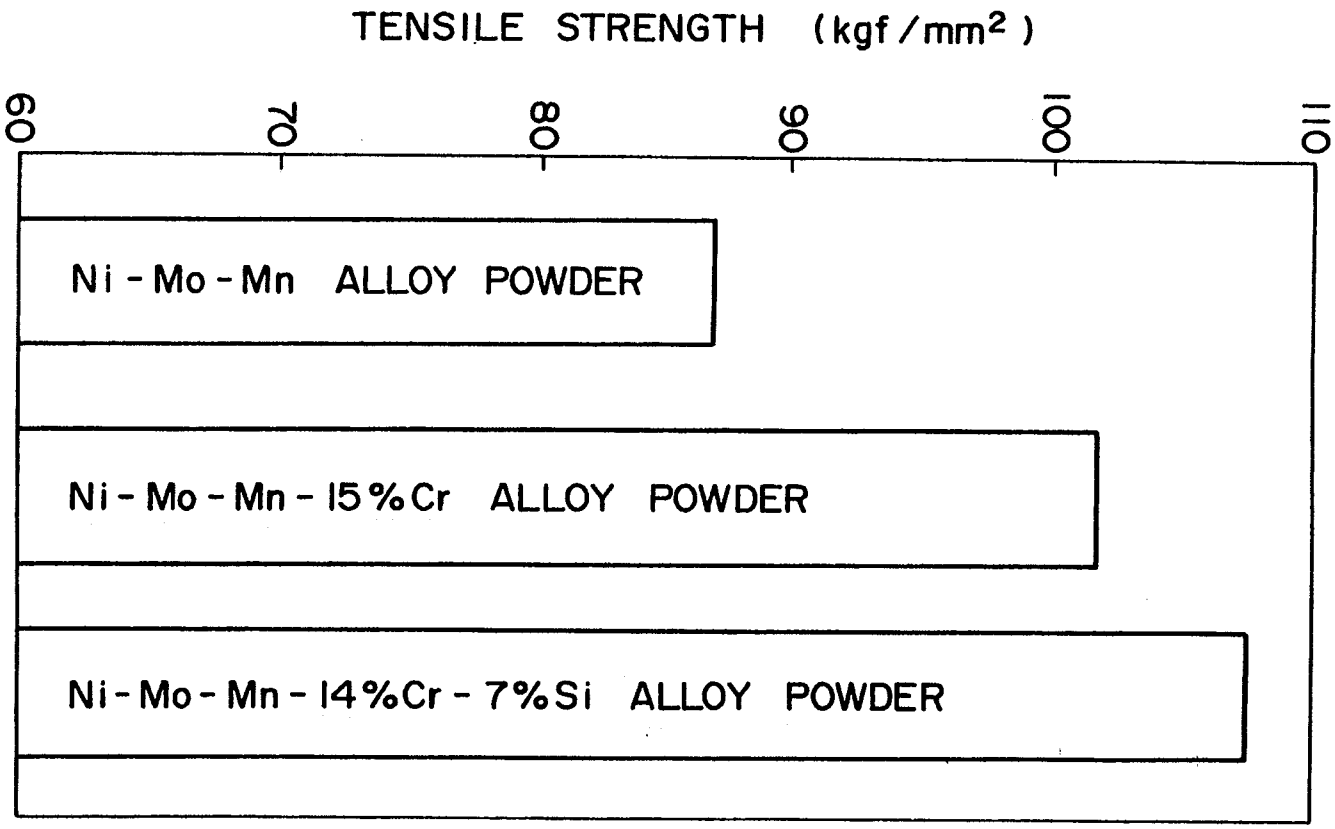
FIG. 7 is a graph illustrating an effect of the composition of the alloy powder on the tensile strength of a sintered product.

FIG. 6 is a graph illustrating a relationship between the amount of the liquid phase formed from the alloy powder and the tensile strength of the sintered product in which the amount of the liquid phase is adjusted by varying the mixing ratio between the alloy powder with the liquidus line lower than the sintering temperature and the alloy powder with the liquidus line lower than the sintering temperature. As apparent from FIG. 6, the strength of the sintered product increases as the amount of the liquid phase increases and the strength increases remarkably if the amount of the liquid phase is more than 20%. This is considered to be a relationship with respect to the amount of the liquid phase prevailing between each of the Fe particles and, since a 6% alloy powder is used in this example, 20% amount of the liquid phase corresponds to about 1.2% for the entire sintered product.

EXAMPLE 2

In the same procedures as those in Example 1, various kinds of sintered products were produced, the tensile strength of the resultant sintered products was measured and the effect of the alloy composition on the tensile strength was investigated. The alloy powder used was produced by water atomization and had an mean particle size of about 17 μm, in which various kinds of elements were incorporated to the basic ingredients of Ni—Mo—Mn in the same manner as in Example 1.

Figure 8:
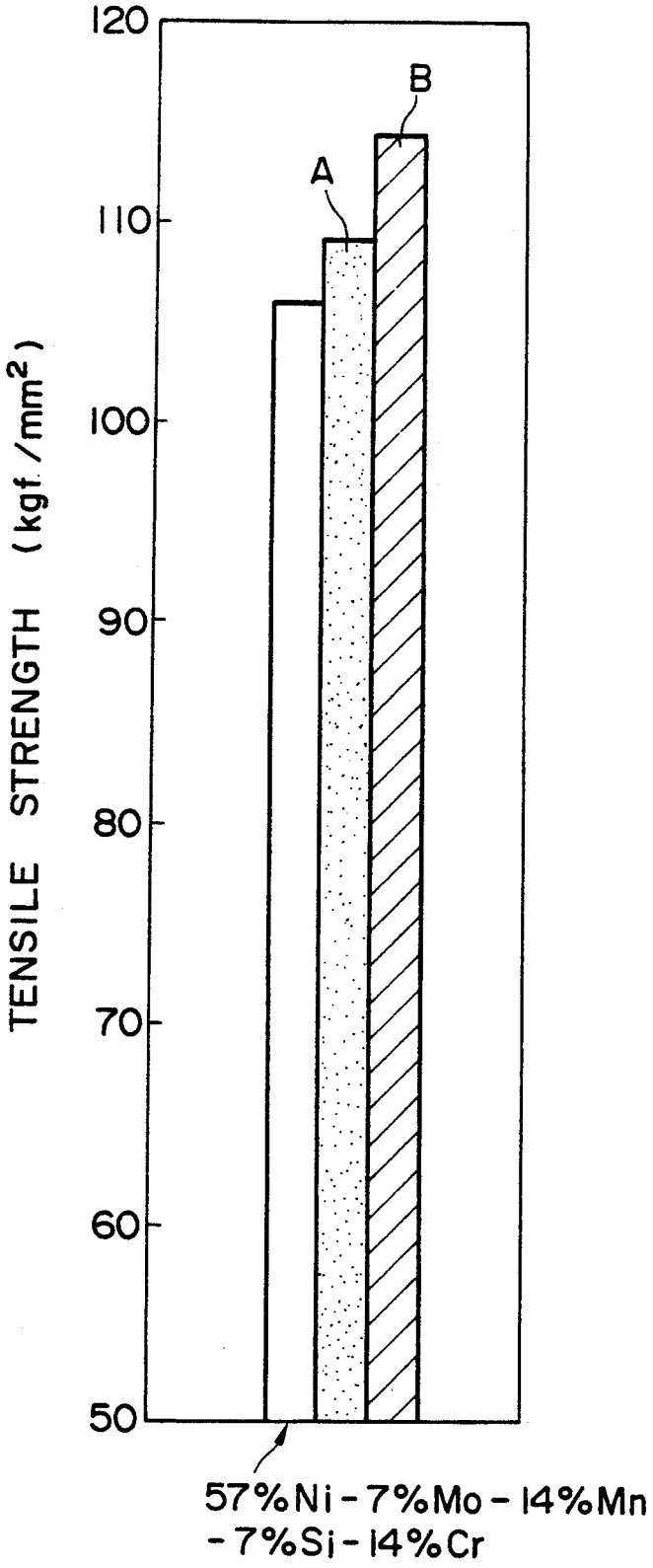
FIG. 8 is a graph illustrating an effect of the composition of the alloy powder on the tensile strength of a sintered product.

The results are shown in FIG. 8 and it can be seen that the strength is increased by incorporating other one of ingredient and the strength is further increased by the addition of two or more ingredients as compared with the case of the basic ingredients Ni—Mo—Mn.

FIG. 8 is a graph illustrating an effect of the alloy powder composition on the tensile strength of the sintered product, in which change of strength is shown by comparison between (A) a case of incorporating 0.6% B and a case (B) incorporating 0.5% B, 1% Al and 1% Ti, to Ni—7%Mo—14%Mn—14%Cr—7%Si ingredients. The production conditions are the same as described above.

As apparent from FIG. 8, addition of B, Al, Ti is also extremely effective to the improvement of the strength.

The present inventors have investigated for the reason causing the phenomenon described above while comparing multi-ingredient systems in which 14% Cr, 14% Mn, 7% Si are incorporated into (1) Ni—Mo binary system and (2) Ni—Mo binary system.

Figure 9:
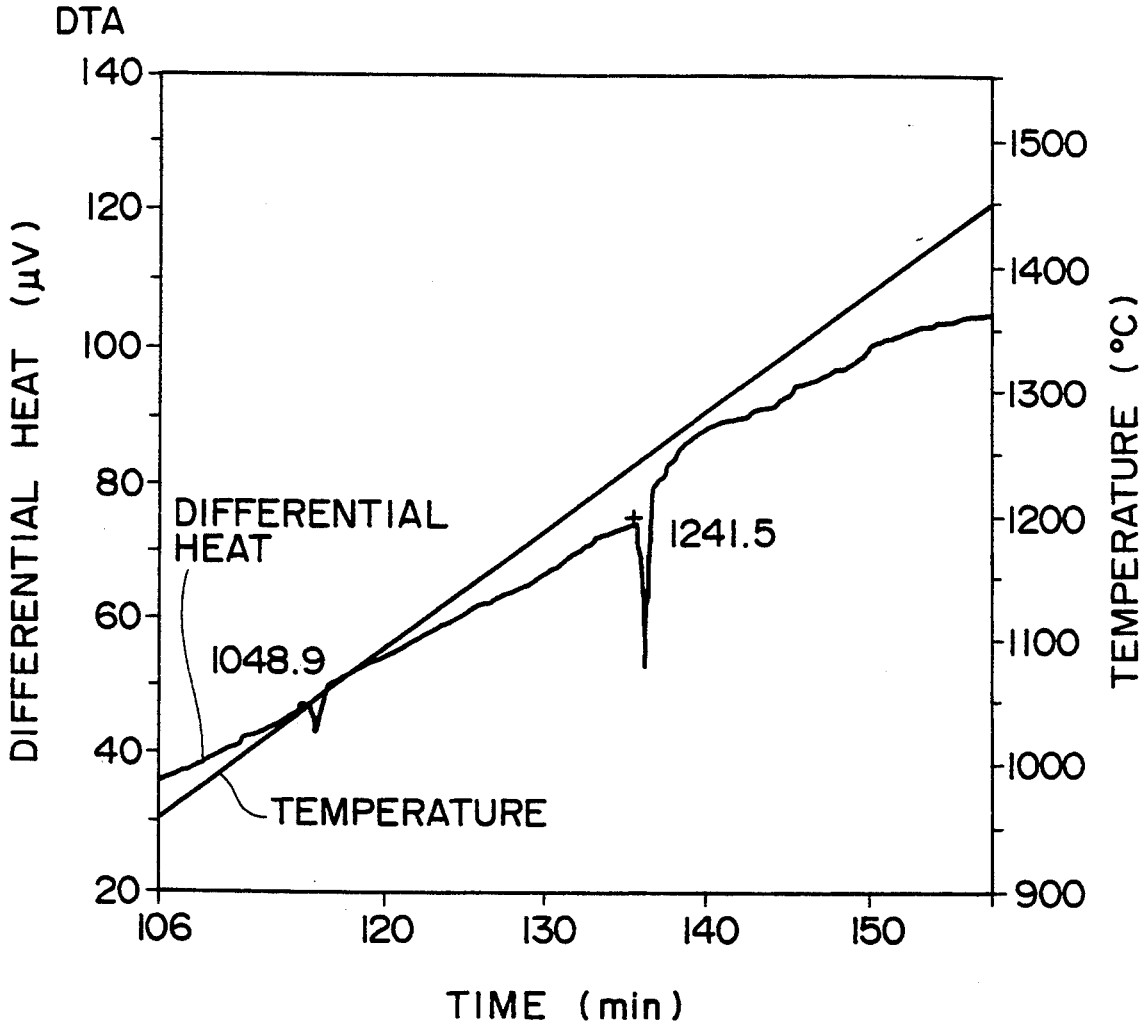
FIG. 9 is a graph illustrating the result of differential thermal analysis for a multi-ingredient alloy powder (Ni—Mo—14%Cr—14%Mn—7%Si)
Figure 10:
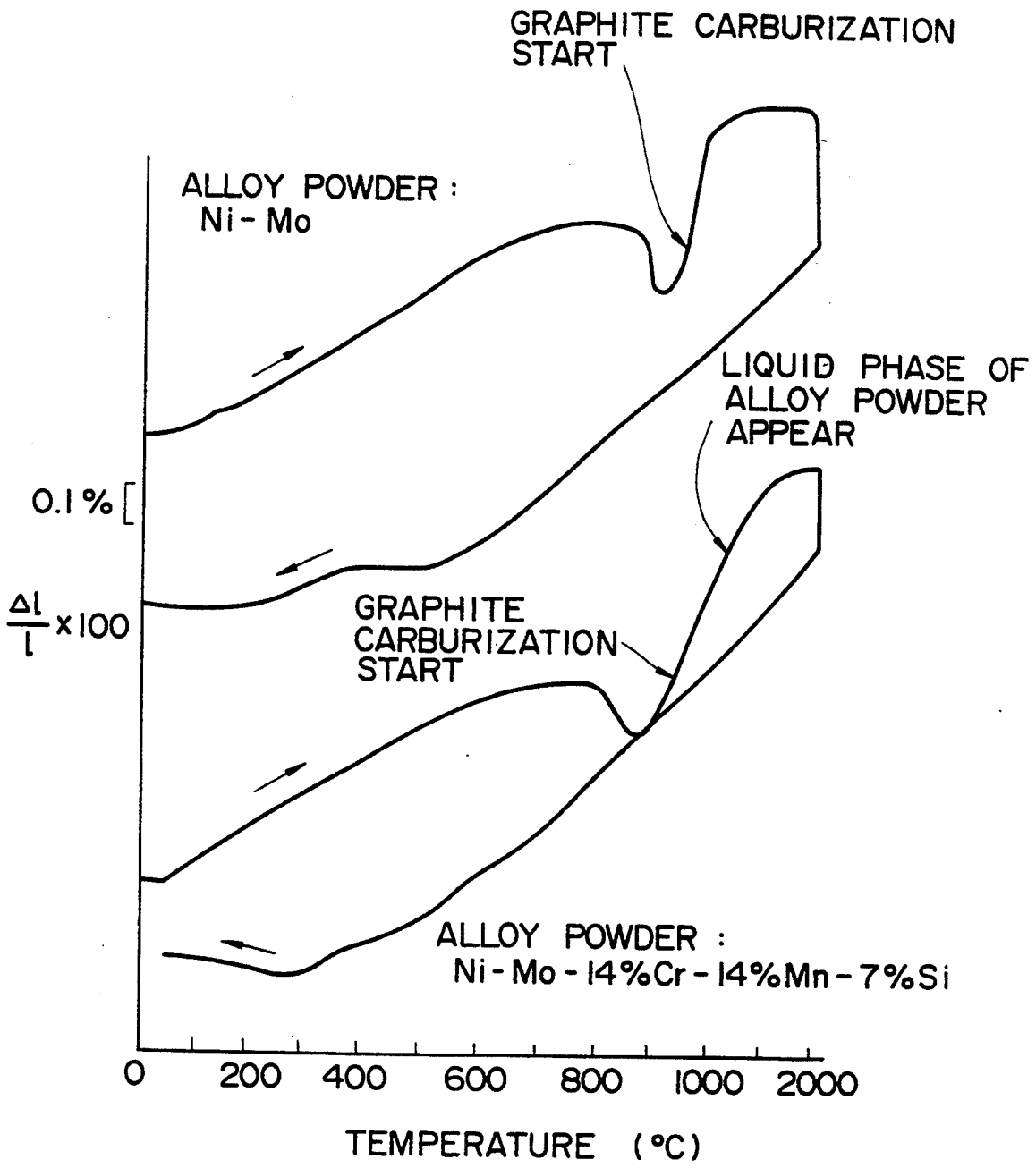
FIG. 10 is a thermal expansion curve upon sintering using each of alloy powders, i.e., Ni—Mo binary and multi-ingredient systems.
Figure 11:
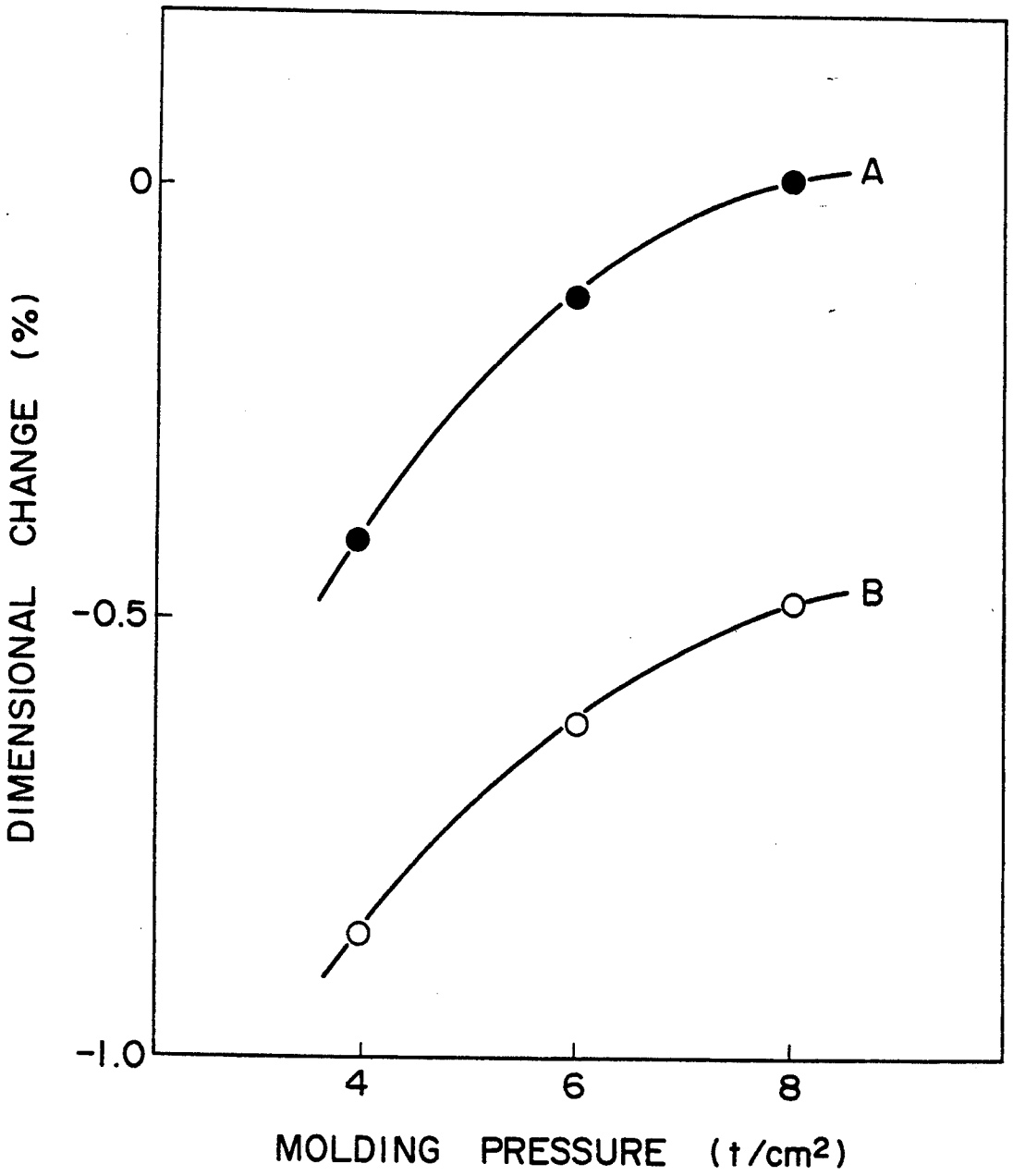
FIG. 11 is a graph illustrating an effect of a compacting pressure on the dimensional change when a multi-ingredient system alloy powder and Ni, Cu, Mo each in pure substance are added to a Fe powder.

FIG. 9 is a graph illustrating the result of differential thermal analysis for the multi-ingredient series alloy powders. It can be seen from the graph that the liquidus phase temperature region is from 1049° to 1263° C. which is considerably lower as compared with about 1420°-1440° C. for the basic ingredients. That is, while the diffusion of the alloying ingredients proceeds in a solid phase state at a sintering temperature (about 1300° C.) in a case of using a Ni—Mo ingredient system, diffusion of the alloying ingredients is taken place in a liquid phase in a case of using a multi-ingredient system to cause vigorous diffusion and sintering. FIG. 10 shows thermal expansion curves for both of them during sintering. While graphite carburization is completed about from 900° C. to 1070° C., a liquid phase develops about from the substantial completion of carburization in the multi-ingredient system, and the entire liquid phase has substantially be developed completely up to reaching of the sintering temperature. It is important that the appearance of the liquid phase deviates from the time of graphite carburization and, if the development of a great amount of the liquid phase overlaps with the time of vigorous carburization, the sintered product expands remarkably to extremely reduce the strength. On the other hand, in a system in which Ni, Cu, Mo or the like is added as a pure substance to the Fe powder, for example, containing 4% Ni, 1.5% Cu and 0.5% Mo, the sintered product shrinks remarkably during sintering. FIG. 11 shows the result of the dimensional change in the system of pure substance (line B) and the system of the present invention (for example, Ni—7%-Mo—14%Mn—7%Si—14%Cr alloy powder is added by 6% to the Fe powder: Line A). In the sintered product using the powder according to the present invention, the dimensional change after sintering becomes remarkably small, and it also provides an effect capable of improving the dimensional accuracy and reducing the cost by the saving of subsequent steps.

Figure 12:
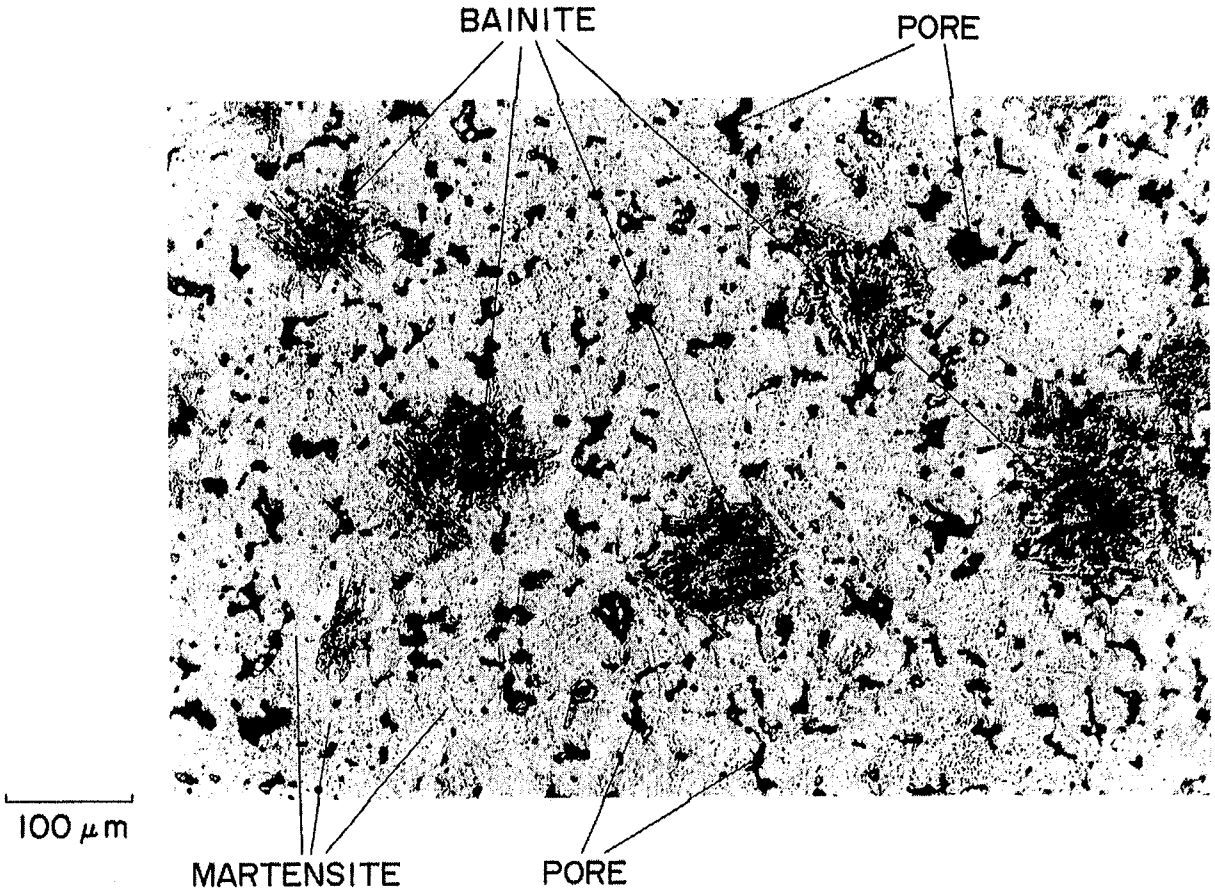
FIG. 12 is a microscopic photograph showing the structure of a sintered product when sintering is conducted by using a mixed powder in which a Ni—7%Mo—14%Mn—7%Si—14%Cr system alloy powder is added to a Fe powder.
Figure 13:
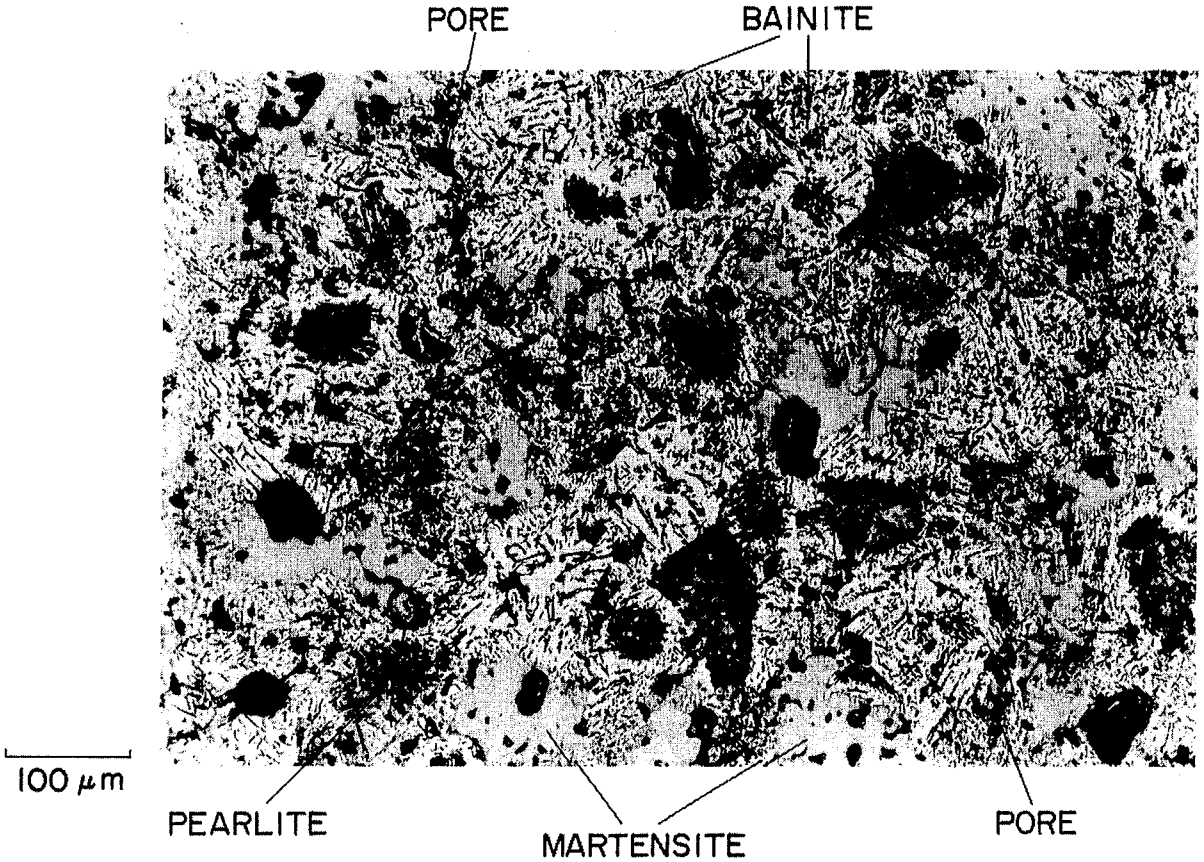
FIG. 13 PRIOR ART
FIG. 13 is a microscopic photograph showing the structure of a sintered product when sintering is conducted by using a mixed powder in which Ni, Cr and Mo in pure substance are added by 4.0%, 1.5% and 0.5%, respectively, to a Fe powder.

FIG. 12 is a microscopic photograph showing the structure of sintered product when a mixed powder comprising a Ni—7%Mo—14%Mn—7%Si—14%Cr alloy powder is added by 6% to the Fe powder is sintered (product of the invention). It can be seen from the photograph that a homogeneous transformation-reinforced structure (martensite) developed into a network configuration along the grain boundary of the Fe powder contributes to the reinforcement of the grain boundary. On the other hand, FIG. 13 is a microscopic photograph showing the structure of a sintered product when a mixed powder in which each of pure substances of Ni, Cu and Mo is added by 4.0%, 1.5%, 0.5%, respectively, to the Fe powder is sintered (conventional product). It can be seen from the figure that the structure mainly comprises bainite in which the grain boundary of the Fe powder is distinctly observed.

EXAMPLE 3

The present inventors have investigated, from various aspects, how the kind (type) of the Fe powder and the grain size of the alloy powder contribute to the development of the strength of the sintered product.

At first, the effect of the kind of the Fe powder on the development of the strength was investigated using the Fe powder of the chemical ingredients shown in the following Table 1. The production conditions are as described below. That is, a mixed powder comprising iron powder—6% alloy powder—0.6% graphite—0.75% of zinc stearate was compacted under 6 ton/cm$^2$ into a compacting product, it was sintered in a vacuum atmosphere at 1300° C. The alloy powder used herein was prepared by water atomization and had an mean particle size of 17 um penultimate line (mean particle size of alloy power) with the ingredient composition of : Ni—7%Mo—14%Mn—14%Cr—7%Si.

TABLE 1

| No. | Kind of iron powder | Chemical ingredient (wt %) C | Si | Mn | P | S | O | Density of compacting product (g/cm$^3$)* |
|---|---|---|---|---|---|---|---|---|
| 1 | 300 M | 0.02 | 0.05 | 0.1–0.3 | 0.02 | 0.02 | 0.25 | 7.06 |
| 2 | 300 MXI | 0.01 | 0.03 | 0.10 | 0.10 | 0.10 | 0.20 | 7.06 |
| 3 | 300 MH | " | " | " | " | " | " | 7.12 |
| 4 | 100 NM | 0.01 | 0.03 | 0.05 | 0.005 | 0.005 | 0.10 | 7.16 |

Figure 14:
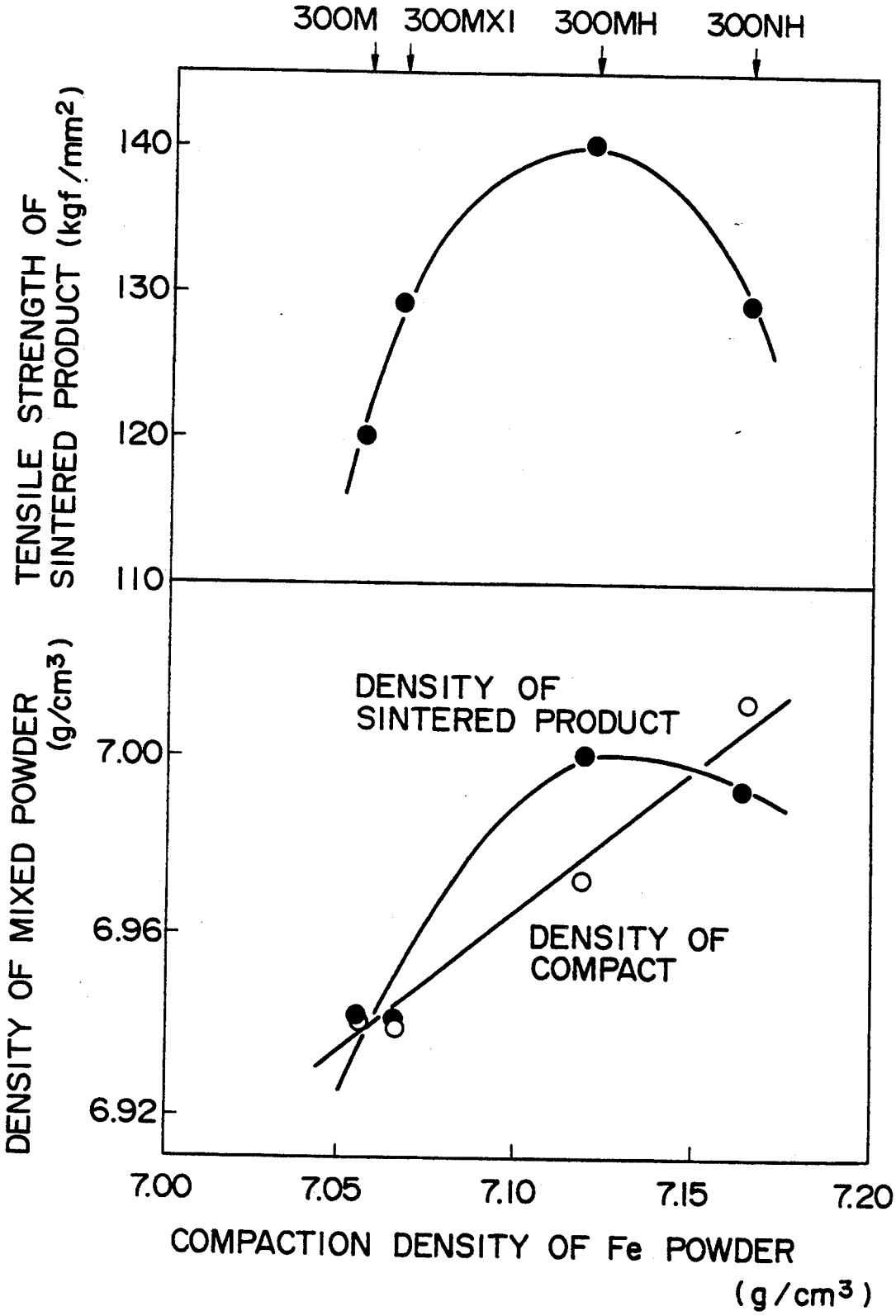
FIG. 14 is a graph illustrating an effect of the kind of a Fe powder on the development of the strength.

*Value measured for the product obtained by mixing 0.75% zinc stearate and compacted at 6 ton/cm$^2$ The results are shown in FIG. 14 and it can be considered as follows based on FIG. 14. Generally, the tensile strength of a sintered product tends to be increased as the density of the Fe powder becomes higher, in which the strength of a Fe powder of higher purity (300NH) is lower than that of lower purity. Accordingly, it can be seen that use of a Fe powder of low purity is preferred in view of increasing the strength of the sintered product.

Figure 15:
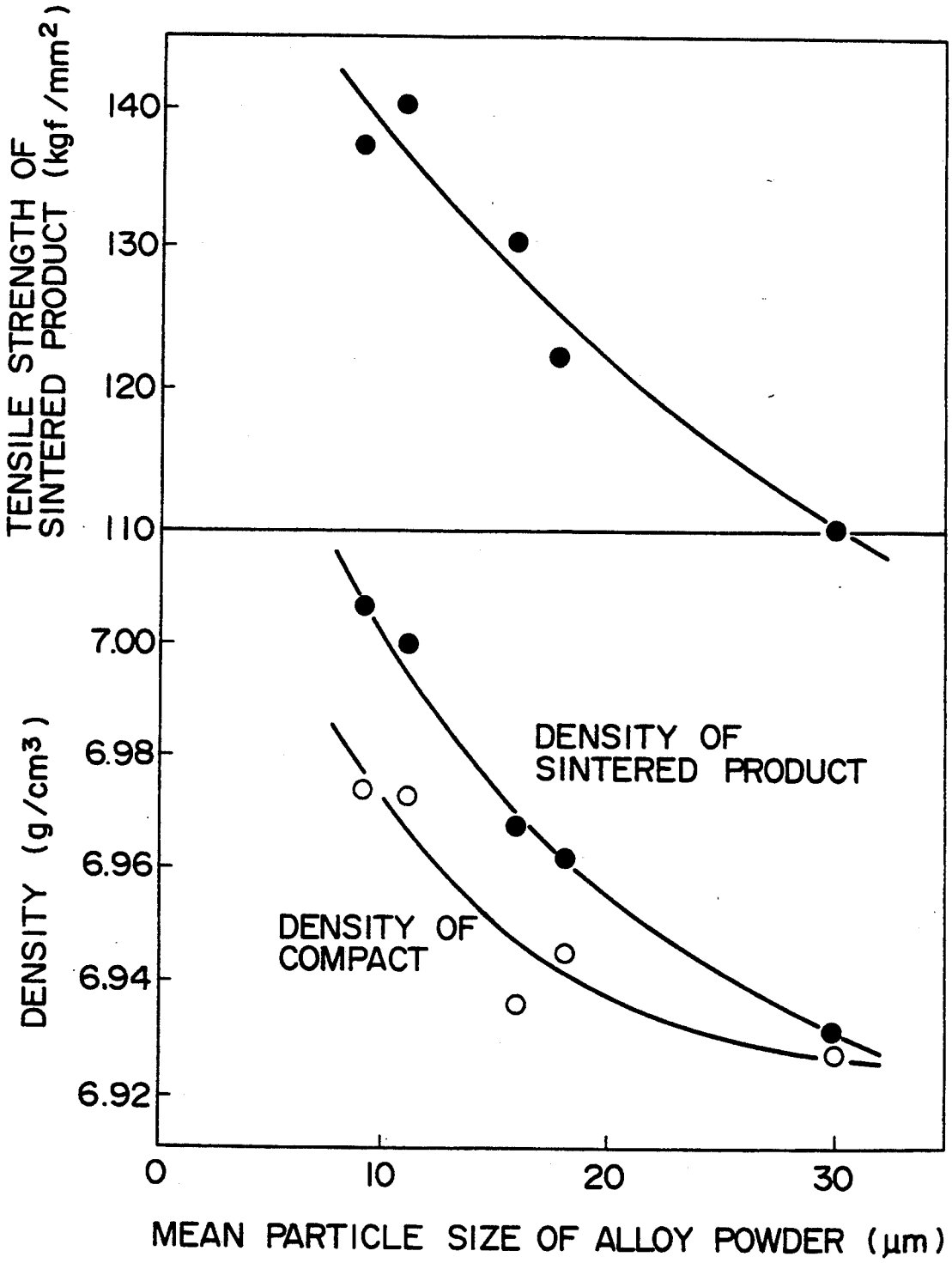
FIG. 15 is a graph illustrating an effect of the mean particle size of an alloy powder on the tensile strength and the density.

FIG. 15 is a graph illustrating an effect of the mean particles size of the alloy powder on the tensile strength (sintered product) or the density (compacting product and the sintered product). The sintered product and the compacting product in this case were produced by using 300MH as the Fe powder and under the same production conditions as described above. As can be seen from FIG. 15, it is preferred that the mean particle size of the alloy powder is less than 20 μm.

Then, the effects of the mean particle size of the graphite powder on the density of the compacting product or the sintered product, the mechanical properties of the sintered product (tensile strength, impact value) were investigated by using graphite having a mean particle size of 4 μm (CPM-4), 5 μm (SW1651) and 12 μm (ACP), respectively. The conditions were the same as those described above excepting for using 300NH as the Fe powder.

Figure 16:
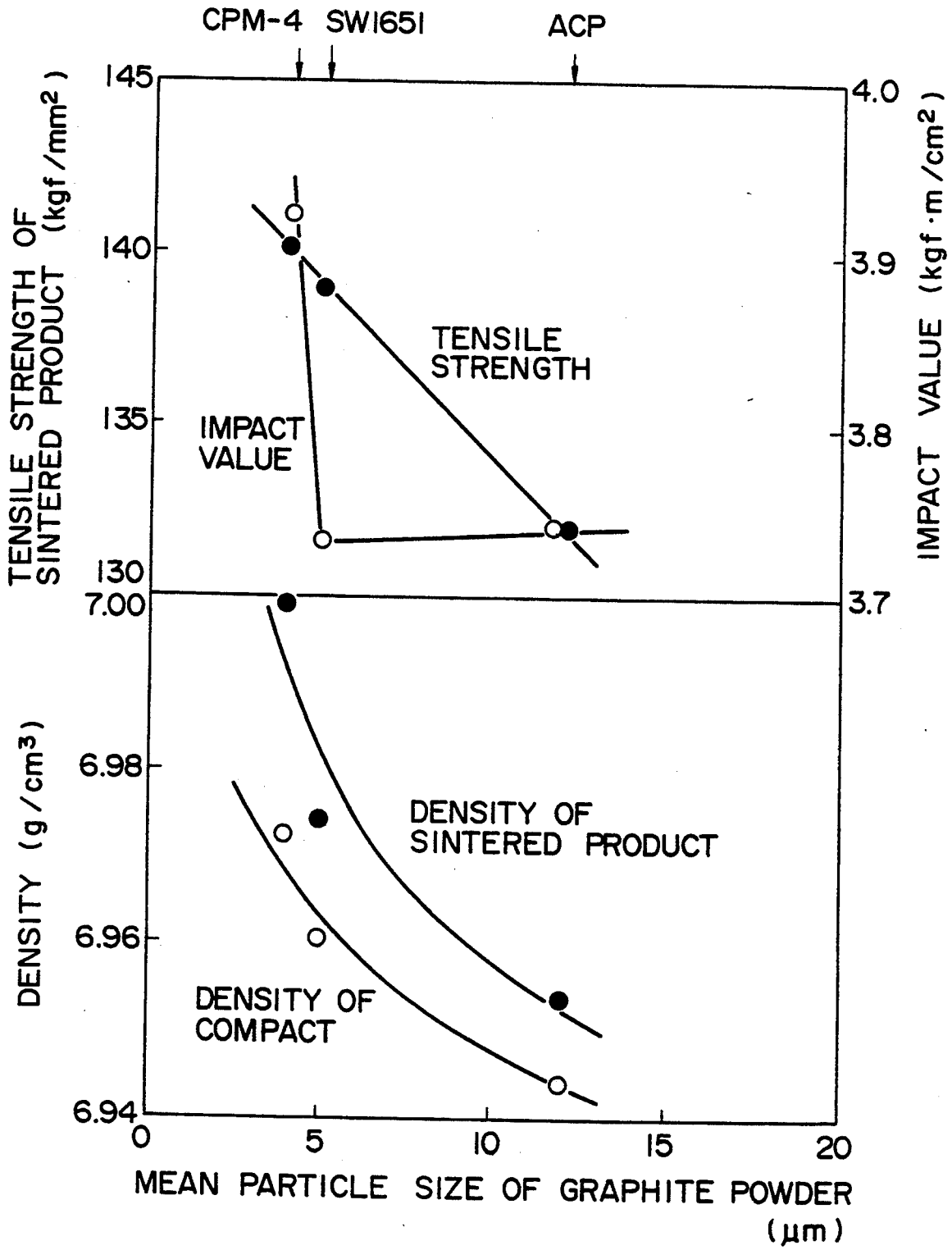
FIG. 16 is a graph illustrating an effect of a mean particle size of a graphite powder on the density of a compacted product and a sintered product and the mechanical property of the sintered product.

The results are shown in FIG. 16. As apparent from FIG. 16, high density can be attained as the particle size of the graphite becomes smaller, which reflects on the increase of the tensile strength of the sintered product. It can be seen that higher impact value can be obtained by using the graphite with a mean particle size of less than 5 μm.

Figure 17:
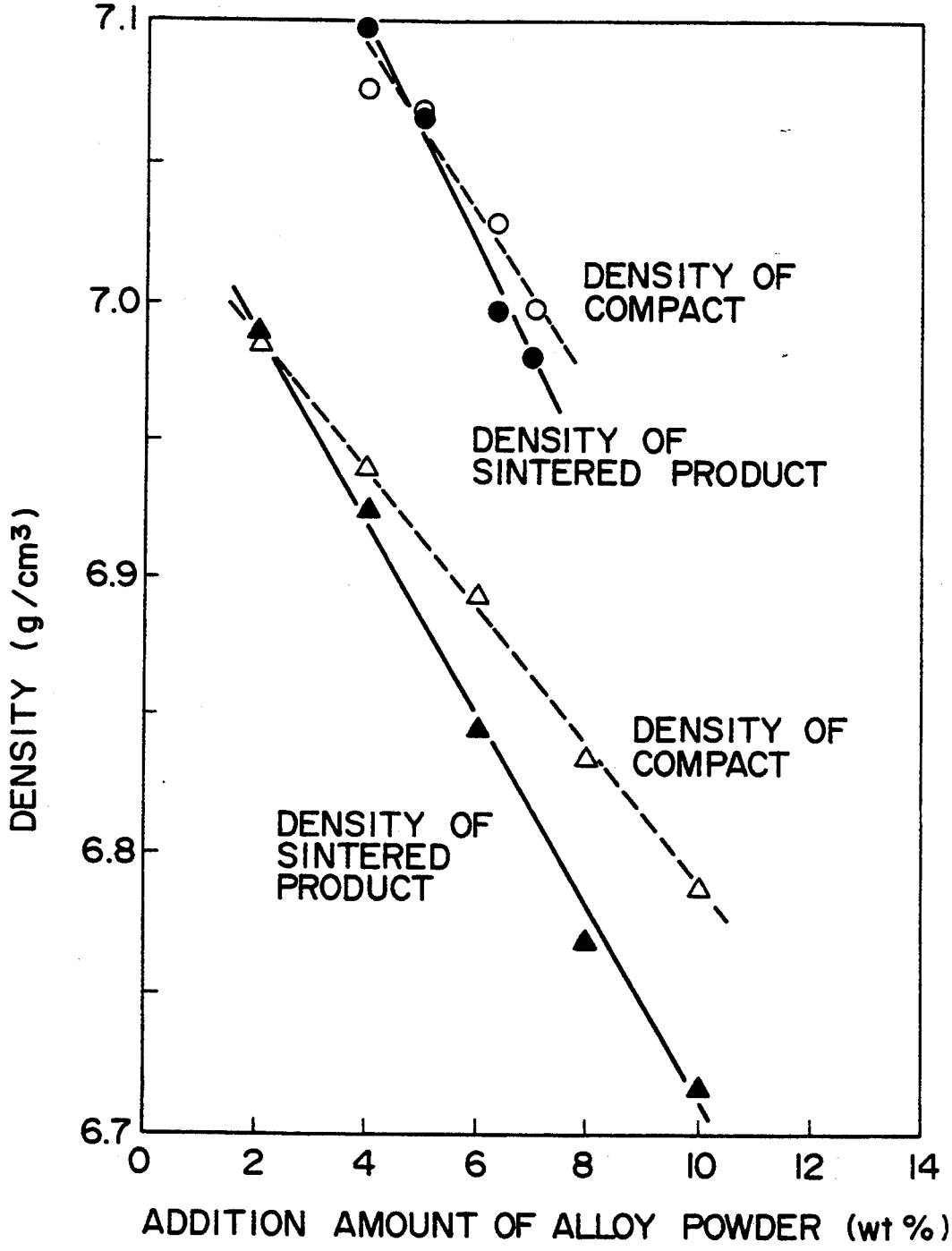
FIG. 17 is a graph illustrating an effect of the addition amount of an alloy powder on the density.

FIG. 17 is a graph illustrating an effect of the addition amount of the alloy powder on the density. As can be seen from FIG. 17, the density lowers as the addition amount of the alloy powder increases, which indicates that there is an appropriate range for the addition amount of the alloy powder.

Figure 18:
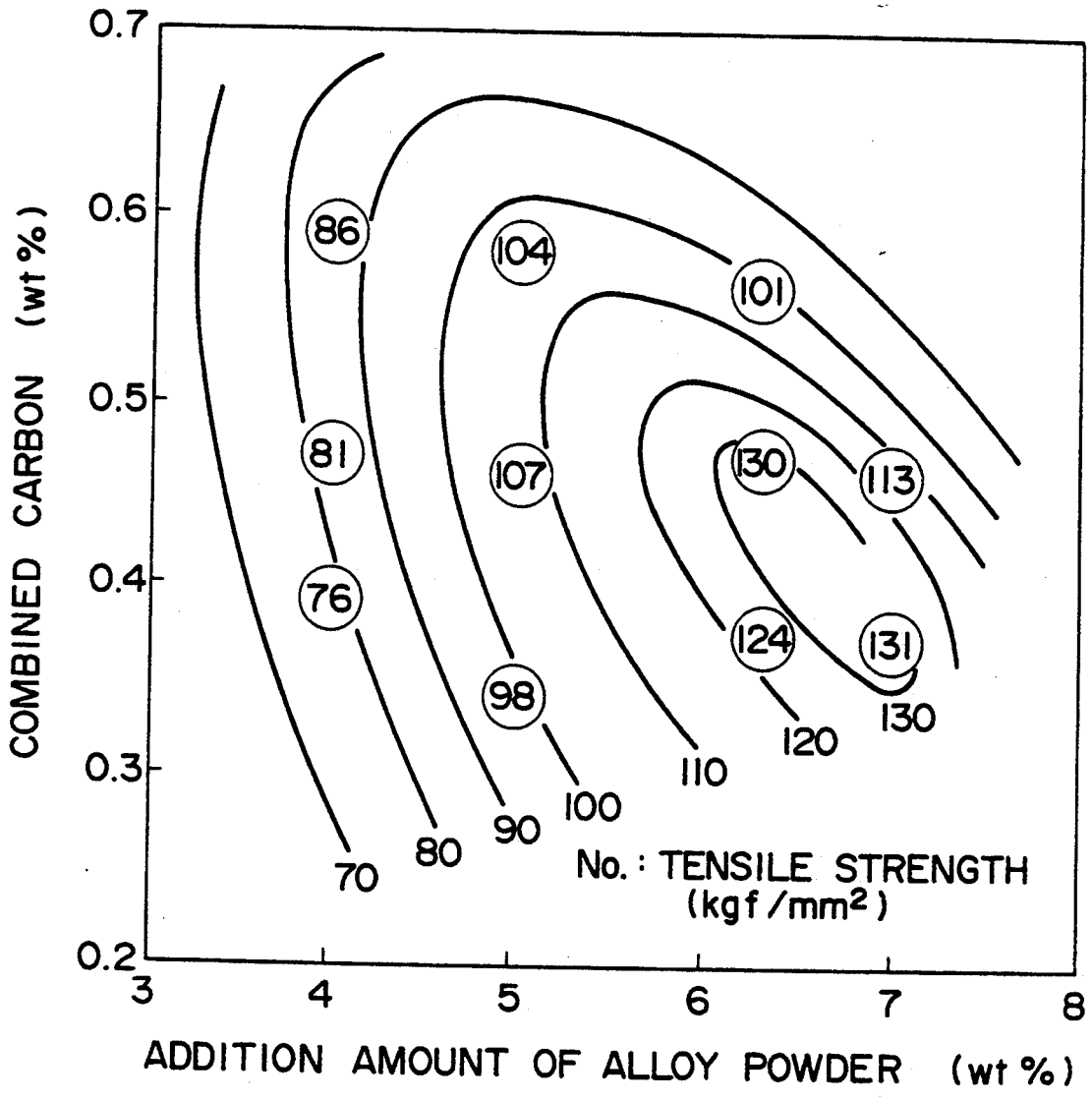
FIG. 18 is a graph illustrating an effect of a relationship between the addition amount of an alloy powder and a combined carbon on the tensile strength.
Figure 19:
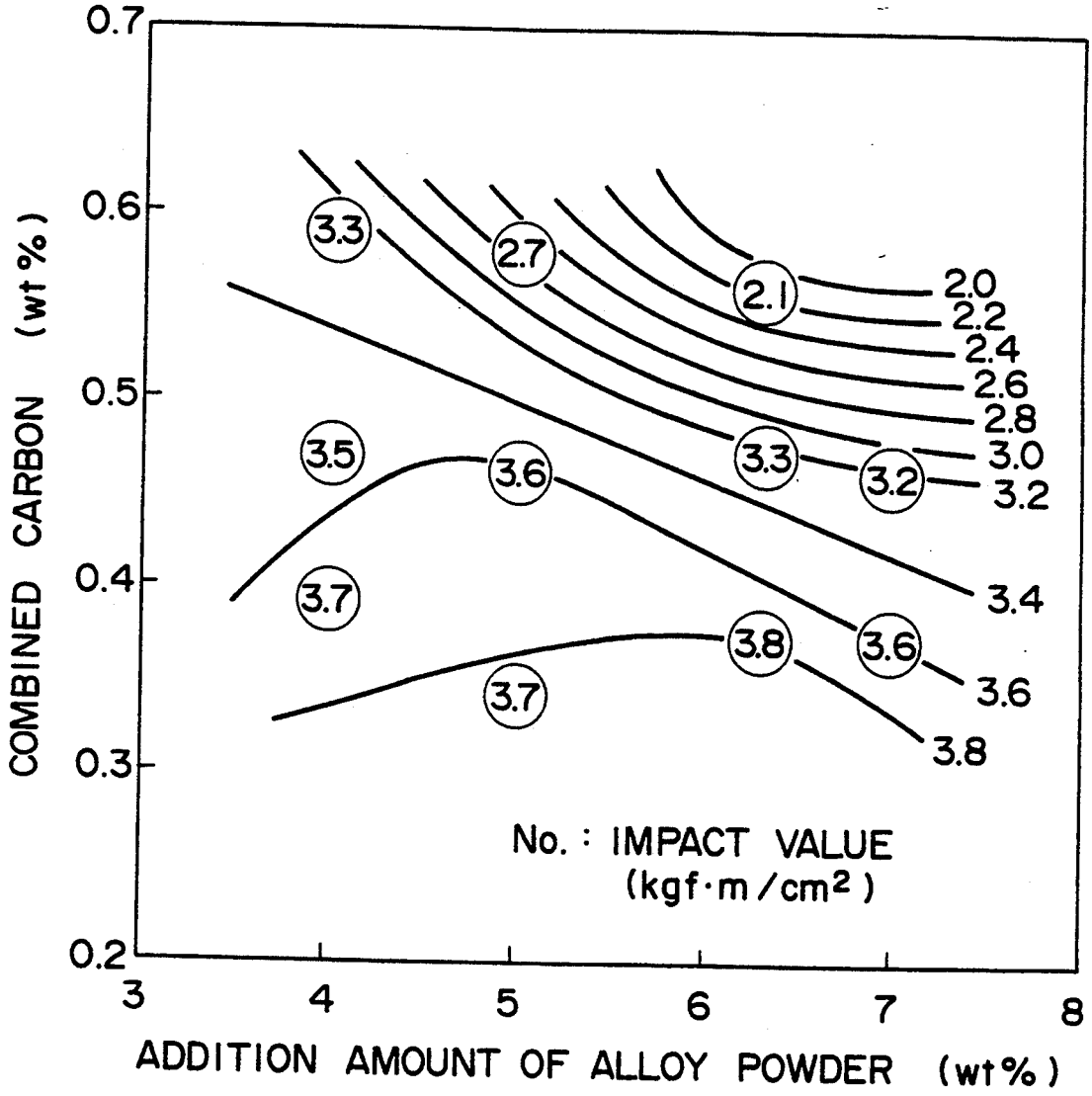
FIG. 19 is a graph illustrating an effect of a relationship between the addition amount of the alloy powder and the combined carbon on the impact value.

FIGS. 18 and 19 are graphs illustrating the effects of a relationship between the addition amount of the alloy powder and the combined carbon on the tensile strength (FIG. 18) and the impact value (FIG. 19). From the results, it can be seen that the addition amount of the alloy powder and the combined carbon (accordingly, the particle size and the production conditions for graphite) can be conditioned properly depending on the production (application use) required for the sintered product.

The present invention has thus been constituted, and a sintered product having high density and high strength and uniform properties can be obtained by using the alloy powder to be added in the form of a multi-ingredient system to thereby reduce the temperature at which the liquid phase appears and setting the temperature at which the liquid phase appears to higher than 950° C. and the lower than 1300° C. while setting the amount of liquid phase during sintering to more than 20%. Further, deviation between the temperature at which the liquid phase appears and the carburization temperature reduces the dimensional change during sintering thereby enabling to obtain an advantageous effect capable of improving the dimensional accuracy of the sintered product and reducing the cost by saving subsequent steps.

What is claimed is:

1. A mixed powder for powder metallurgy comprising a Fe powder and an alloy powder mixed together, wherein the solidus line temperature of the alloy powder is higher than 950° C. and lower than 1300° C., the amount of liquid phase formed by the alloy powder during sintering is more than 20%, and the mean particle size of the alloy powder is smaller than 20 μm.

2. A sintered product prepared by sintered the mixed powder as defined in claim 1, in which the structure of the sintered product comprises a homogeneous martensite structure developed into a network configuration along the grain boundary of the Fe powder.

3. The mixed powder for powder metallurgy as claimed in claim 1, wherein the alloy powder comprises Ni, Mo and Mn as the essential ingredients and also contains one or more of elements selected from the group consisting of Cr, Si, Al, Ti, P, V, Nb, Sn, W Co, Cu and B, the weight ratio of Ni to Mo is from 95/5 to 45/55, and the wt. % of Mn is from greater than 5% to less than 50% based on the total weight on Ni and Mo.

4. A sintered product prepared by sintering the mixed powder as defined in claim 3, in which the structure of the sintered product comprises a homogeneous martensite structure developed into a network configuration along the grain boundary of the Fe powder.

5. The mixed powder for powder metallurgy as claimed in claim 3, wherein said powder contains Cu, and wherein said Cu is present in an amount less than 10 wt. % based on the total weight of the alloy powder.

6. The mixed powder for powder metallurgy as claimed in claim 1, wherein the weight ratio of alloy powder to Fe powder is from 0.01 to 0.12.

7. The mixed powder for powder metallurgy as claimed in claim 1, wherein the weight ratio of alloy powder to Fe powder is from 0.02 to 0.06.

8. The mixed powder for powder metallurgy as claimed in claim 3, wherein the weight ratio of alloy powder to Fe powder is from 0.01 to 0.12.

9. The mixed powder for powder metallurgy as claimed in claim 3, wherein the weight ratio of alloy powder to Fe powder is from 0.02 to 0.06.

* * * * *